US006605006B2

(12) United States Patent
Mason

(10) Patent No.: US 6,605,006 B2
(45) Date of Patent: Aug. 12, 2003

(54) GOLF CLUB

(76) Inventor: Milton T. Mason, 6 Deerhurst Rd., San Antonio, TX (US) 78218

( * ) Notice: Subject to any disclaimer, the term of this patent is extended or adjusted under 35 U.S.C. 154(b) by 0 days.

(21) Appl. No.: 09/947,505

(22) Filed: Sep. 7, 2001

(65) Prior Publication Data

US 2002/0006833 A1 Jan. 17, 2002

Related U.S. Application Data

(63) Continuation-in-part of application No. 09/610,324, filed on Jul. 5, 2000, now Pat. No. 6,342,018.

(51) Int. Cl.[7] ..... A63B 53/04

(52) U.S. Cl. ..... 473/252; 473/328; 473/331; 473/350

(58) Field of Search ..... 473/251, 252, 473/253, 254, 255, 324, 328, 327, 330, 345, 268, 331, 350

(56) References Cited

U.S. PATENT DOCUMENTS

| | | | | |
|---|---|---|---|---|
| D213,326 | S | 2/1969 | Driscoll | |
| D225,419 | S | 12/1972 | Mills | |
| 5,354,059 | A * | 10/1994 | Stuff | 473/329 |
| 5,437,088 | A * | 8/1995 | Igarashi | 29/527.5 |
| 5,458,335 | A | 10/1995 | Hattori | |
| 5,505,450 | A * | 4/1996 | Stuff | 473/329 |
| 5,533,728 | A | 7/1996 | Pehoski et al. | |
| 5,637,044 | A * | 6/1997 | Swash | 473/251 |
| 5,690,556 | A | 11/1997 | Condon | |
| D394,688 | S | 5/1998 | Fox | |
| 5,746,666 | A | 5/1998 | Lovett | |
| 5,830,082 | A | 11/1998 | White | |
| D405,137 | S | 2/1999 | Nelson | |
| 6,183,379 | B1 * | 2/2001 | Kim et al. | 473/325 |
| 6,224,497 | B1 * | 5/2001 | Antonious | 473/330 |
| 6,267,690 | B1 * | 7/2001 | Salmon | 473/325 |
| 6,398,665 | B1 * | 6/2002 | Antonious | 473/330 |

FOREIGN PATENT DOCUMENTS

| | | |
|---|---|---|
| EP | 0 608 128 | 7/1994 |
| GB | 219804 | 8/1924 |
| GB | 1432688 | 4/1976 |
| JP | 2000-296191 | * 10/2000 |

* cited by examiner

*Primary Examiner*—Stephen Blau

(57) ABSTRACT

A golf club for effecting shots within sixty yards of play to the "green". The golf club includes two distinct shaft configurations and has a club head with a striking face or impact surface which gradually narrows downwardly to a rounded bottom edge to form a convex shaped structure having a series of cavity contours for effecting different degrees of impact with a target. The convex top surface of the golf club head has a series of seven colored parallel grooves incorporated thereon to form an optical pattern to help a golfer's eyes focus and to project a more broad-based target line-up. The angle between the line-up defined by the shaft when positioned normally as during play and a line perpendicular to the ground is six to seven degrees.

9 Claims, 10 Drawing Sheets

GOLF CLUB

CROSS-REFERENCE TO RELATED APPLICATION

This application is a continuation-in-part of U.S. patent application Ser. No. 09/610,324, filed Jul. 7, 2000, now U.S. Pat. No. 6,342,018.

BACKGROUND OF THE INVENTION

1. Field of the Invention

The present invention relates generally to golf clubs. More specifically, the invention is an improved golf club for putting.

2. Description of the Related Art

The United States has seen unprecedented growth in the popularity of the game of golf in the past decades. Numerous devices have been made to help golfers improve their shots. Putters and chippers of various designs and markings, golf club heads of various angles, and shafts of different lengths and angles of attachment to the golf club head have been introduced. However, despite many attempts, no suitable golf club exists for making chip-shots often less than sixty yards long and approximately four to five feet off the ground. This includes, for example "bump and run" shots. All golfers agree that ninety percent of the game of golf is mental. The other ten percent is primarily physical aptitude including some measure of athleticism.

For the purpose of moving a golf ball from the tee to the green and ultimately into the hole, a golfer is permitted thirteen clubs. Woods (also "metal woods") are available to project the golf ball the greatest distance. The club head is usually quite large by comparison and has very little loft (typically eight to thirteen degrees). Iron headed clubs ("irons") are clubs having varying degrees of loft and various shaft lengths. Because of the various club's loft, irons properly used will propel a golf ball forward to various distances and at varying heights above the ground. Wedges (iron headed clubs with significant loft-up to sixty degrees) are available for short shots into the green. Putters are usually iron headed clubs used to roll a golf ball along the putting surface (green) and into the hole. Putters generally have a ball striking surface (loft) of almost ninety degrees. Providing a golfer with a variety of clubs enables the golfer to take the "same swing" with each club, but get different results in ball flight path and distance. Golf clubs which do not fall within the "same swing" category are wedge and putter clubs Using the same swing with a wedge or a putter will result in the same distant and trajectory result. The "finesse" shot (which involves altering the swing speed, back-swing distance, downward club-head speed, and the golfer's body attitude) enables the golfer to propel the golf ball to varying distances. For most golfers, over fifty percent of the shots advanced toward or into the hole are normally within forty yards. Thus, the finesse shot is one of, if not the most important type shot in the game of golf. However, factors such as fright or nervousness, grass height, grass texture, moisture, sand and/or water obstructions contribute to the number of obstacles which serve to raise the level of difficulty for making a finesse shot. It is for these reasons at least the finesse shot is the most difficult shot to master.

Generally, the finesse shot is attempted with the wedge. But this highly lofted short shaft club invites the golfer to impart lateral movement to the club's face by turning the wrist on impact thereby producing an off-line shot. The easiest shot in golf is the putt. This shot is performed with the use of a putter which does not require turning or breaking the wrist of a golfer as with the use of the wedge. As a result, off-line shots are minimized.

The golf club as herein described alleviates the longstanding need for a golf club which integrates the most definitive features of each conventional type of club cited hereinbelow (e.g. wood, iron, wedge and putter) into a singular hybrid club which solves the problems associated with each conventional club and improves the game of golf for golf enthusiasts and professionals within roughly sixty yards of the hole or from the "rough" onto the "green" without the need for extensive practice.

For example, U.S. Pat. No. 5,690,556, issued to Condon, shows a multi-functional golf club head which can be used as either a putter or a chipper, depending on the nature of the terrain on the golf course, having ball centering indicia on the top face, rails on the bottom of the club head, and an angled striking surface. However, this device does not have the optical assisting pattern of the present invention, which is specially designed to maximize a golfer's eye's focus and project a broad-based target line-up to make it easier for the golfer to keep the swing line of the club head on track with the intended path of the ball. U.S. Design Pat. No. 213,326, issued to Driscoll, discloses the ornamental design for golf club head. U.S. Design Pat. No. 225,419, issued to Mills, shows an ornamental design for an golf club. U.S. Design Pat. No. 394,688 also illustrates an ornamental design for a golf club head. And U.S. Design Pat. No. 405,137 shows the ornamental design for a golf putter head.

U.S. Pat. No. 5,458,335, issued to Hattori, reveals a combined putter and wedge golf club having both putting and chipping faces on either side of the club head, which is connected to a shaft rigidly mounted perpendicular to the club, in comparison to the present invention where the angle between the line defined by the shaft, when the putter is in normal play position, and the line perpendicular to the ground is six to seven degrees.

And U.S. Pat. No. 5,533,728, issued to Pehoski et al., discloses a golf putter head having a striking surface separated from and parallel to body of the head by a spaced portion.

U.S. Pat. No. 5,746,666, issued to Lovett, shows a golf club having a striking face which angles down narrowly to form a blunt lower apex. The narrow lower apex of this device allows for less contact with the turf during a golf swing, decreasing turf drag to allow shots of at least 170 yards away. Unlike the present invention, which has a broader bottom wall, this club is not specially designed for shots of sixty or fewer yards, neither does it have optical orientation grooves disposed on the top surface of the golf head to assist s golfer in increasing shot accuracy. U.S. Pat. No. 5,830,082, issued to White, shows a golf chipper club construction in which the club head loft is about 30 degrees, while the descent of the sole is approximately 12 degrees. And the angle from horizontal to the grip axis is 80 degrees. The British Patent granted to McKenzie (BR 219,804) shows a golf club having a streamlined head with a curved taper. The British Patent granted to Miyamoto (ER 1,432, 682) provides a club with a rotatable moveable head having a plurality of faces for hitting at different angles. And the European Patent granted to Schmidt (EP 608,128) discloses a golf putter having a recess disposed on the putter head.

None of the above inventions and patents, taken either singularly or in combination, is seen to describe the instant invention as claimed. Thus a golf club for chipping solving the aforementioned problems is desired.

SUMMARY OF THE INVENTION

The golf club according to the invention includes a short shaft fixedly attached to a golf club head. The striking face or surface of which has a configuration which gradually narrows downwardly to a rounded bottom edge of the striking face and forms a leading edge of the striking face when a stroke is initiated. A side view of the club shows it to be generally convex in shape. The leading edge of the striking face is also slightly superior to the turf-contacting surface by about an eighth of an inch. The bottom edge of the striking front surface converges for a short ways downwards to form a relatively convex bottom surface. A side extends rearwardly and upwardly from the bottom surface of the club head to meet the top surface of the golf club extending rearwardly from the front striking surface. The club is fitted with a long shaft which forces the golfer into an upright "eyes over the ball" position which creates a chipping stroke similar to a normal putting stroke.

The convex top surface of the golf club head has a series of parallel grooves incorporated into the top surface thereof and normal to the top edge of the striking surface. These grooves are colored either orange or white to form an optical pattern to help the golfer's eyes focus and to project a more broad-based target line-up so as to make it easier for the golfer to keep the swing line of the club head, on track with the intended path of the ball. These ball centering grooves are designed to assist the golfer in aligning the golf ball with the target and the best striking area of the club head.

Another distinguishing feature of the club is that the front to-rear surface profile reveals a rounded, convex sole plate mesial to the shaft, making the distal floor plate line angle more angular so as to reduce interference of the club head along the hinge axis at the head of the club. When positioned for play, the angle of the shaft to a line normal to the ground is six to seven degrees. The club integrates or melds certain characteristics of the wood, iron, wedge and putter into a single club.

Accordingly, it is a principal object of the invention to provide a new and improved golf club which allows a golfer to make better putting shots on the green.

It is another object of the invention to provide a golf club having ball centering channels or grooves having a plurality of pigment layers thereon to assist the golfer in aligning the golf ball with the target to improve shot accuracy.

Still another object of this invention is to provide a golf club which is utilizes a curvilinear shaft adapted to a top surface portion of the club head for effecting impact in component forces and/or reaction force directions along the curvilinear portion of the shaft to improve put shots on the green.

Further, it is an object of the invention to provide a golf club having a reinforced epoxy filled cavity as an impact reinforcement and/or absorption material heel component.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a golf club for improving a golfer's putting on the green G. The preferred embodiments of the present invention are depicted in FIGS. 1–4C, and are generally referenced by numerals 5, 7, 7A, 7B, 8 and 9, respectively.

Figure 1:
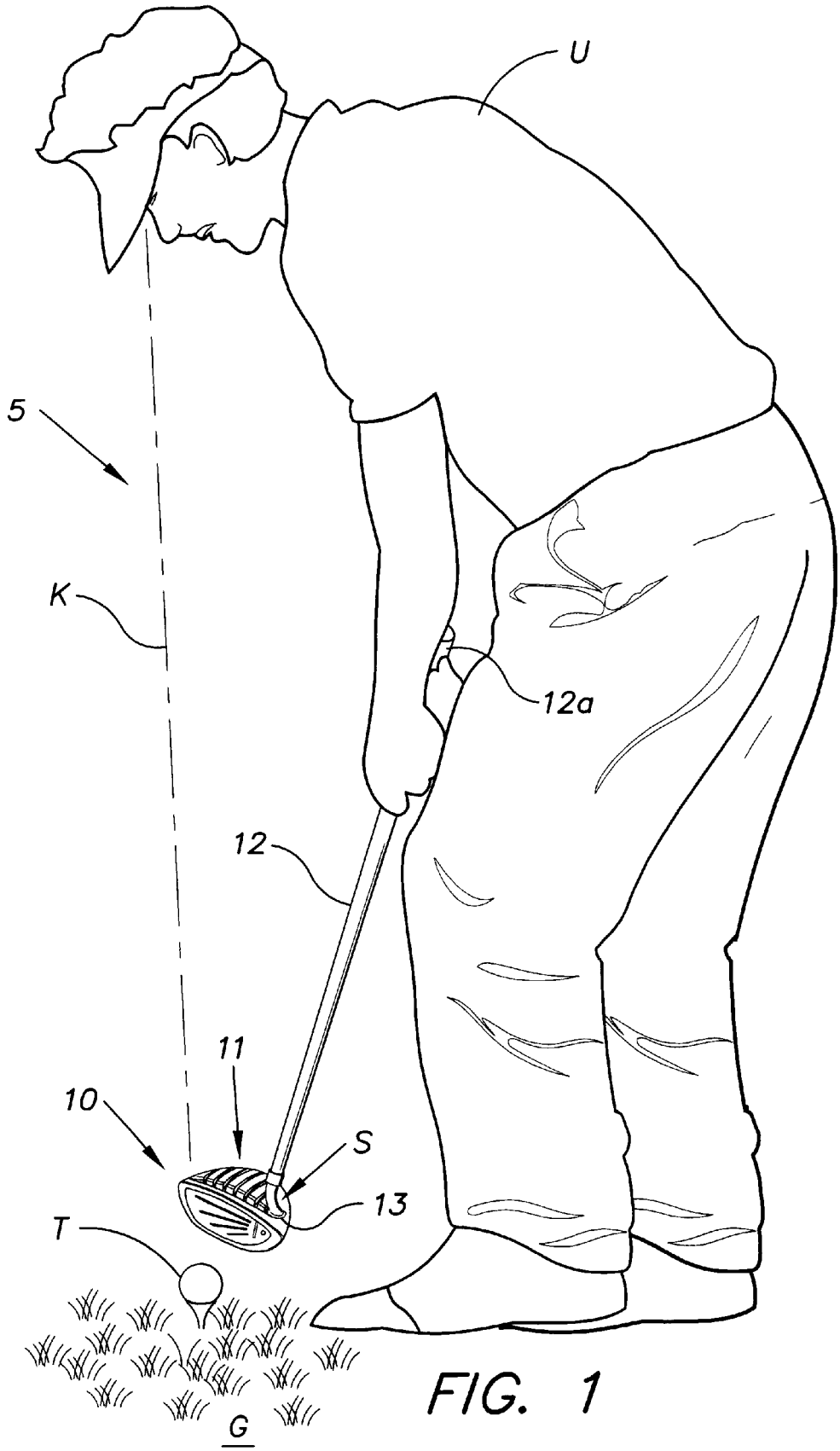
FIG. 1 is an environmental, perspective view of the golf club according to the present invention.

As diagrammatically illustrated in FIG. 1, a golfer U is shown providing a visual line of sight K to colored coded grooves (not shown in color) disposed on and within an alignment surface 11. The alignment surface located on the top surface of the club head 10 serves to assist the user U in projecting a more broad-based target T to a distant location on the "green". As diagrammatically illustrated in FIG. 2A, the golf club 5 for putting comprises a hollow golf club head 10 shaped and formed preferably from a mold. As a finished product, the golf club 5 has a substantially planar impact surface 10*a*, a rear portion 10*b*, a sole portion 10*c*, a top alignment surface 11, a heel portion 10*d* and a shaft 12 aligned according to a predetermined curvilinear arc s or hosel made with respect to the attachment surface 13 via welding. The impact surface 10*a* comprises an impact face-plate 17 with radial grooves 17*a*, 17*b*, 17*c* and 17*d* formed with respect to an impact vertex 19. A substantially perpendicular key-way groove 17*e* is also formed intermediate of the impact vertex 19 and the respective radial grooves 17*a*, 17*b*, 17*c* and 17*d* which serve to grip or control the impact surface contact with a target T. The face-plate 17, impact grooves 17*a*, 17*b*, 17*c*, 17*d*, 17*e* and vertex groove 19 are made of and respectively filled by an epoxy material which can include various pigments to provide a specific aesthetic appeal as a custom feature.

The arc s or adapted hosel is defined by the relation $s=r\theta$ where $\theta$ varies between 0 and 90 degrees, and where r is the radius of curvature of the hosel. The shaft length can be selected from a range defined between or by at least 35 or 40 inches, depended upon the user U specific dimensions, respectively. As diagrammatically illustrated in FIGS. 2A–4C, the golf head 10 is shown to be substantially oblong having a cavity 13*a*, 13*d*, 13*e* and 13*f* with an optional material fill 13*b* or impact reinforcement and absorption material 13*b* as shown in FIG. 2B. The optional fill material 13*b* is preferably an epoxy material which is similarly used to make and respectfully fill the face-plate 17, impact grooves 17*a*, 17*b*, 17*c*, 17*d*, 17*e* and vertex groove 19. While an epoxy material is preferable, other materials such as aluminum alloys or the like, titanium, composite materials or homogeneous light-weight metal materials can be used. The line of demarcation D of the club 7 illustrates the difference between the epoxy material fill 13*b* and the non-epoxy material 13*c*. The epoxy material 13*b* is unique in that it provides an impact cushion or buffer for damping and distributing the component forces generated within the club 7 upon impact with a target T. An aperture 11*a* is formed substantially within a corner top surface 13 of the club 10 for fastening or fixedly attaching the shaft 12 thereto via welding and other finishing techniques which are considered to be well known to one having ordinary skill in the relevant art. According to the other embodiments of the invention, the impact created when the club has made contact with a target T is attenuated by a naturally occurring air gap. A series 15 of grooves 15*a* (first), 15*b* (second), 15*c* (third), 15*d* (fourth), 15*e* (fifth), 15*f* (sixth), and 15*g* (seventh) are formed in parallel with respect to each neighboring or adjacent groove in the series 15 and orthogonal with respect to the impact plate 10*a*. Each groove of the series 15 is formed therein as an arcuate channel which increases in depth from the rear portion 10*b* towards the impact surface 10*a*. The series 15 of substantially arcuate channels or grooves form a color coded optical gauge with channels of differing lengths. As an optical or visual gauge, each groove in the series 15 is color coded via at least one combination laminar and pigment layer for gauging a point of contact with the target T via the impact surface 10*a*. The gauge is utilized by the golfer as an intermediate step of completing a finesse shot, preferably within sixty yards from the green. With more particularity, each laminar layer includes at least one pigment of color for each groove in the series 15 thereby creating an optical pattern from which a golfer can visualize without unnecessary trial and error a specific point of contact or impact with the target T via the impact surface 10*a*. This unique feature of the club improves the short game of the golfer.

Figure 2A:
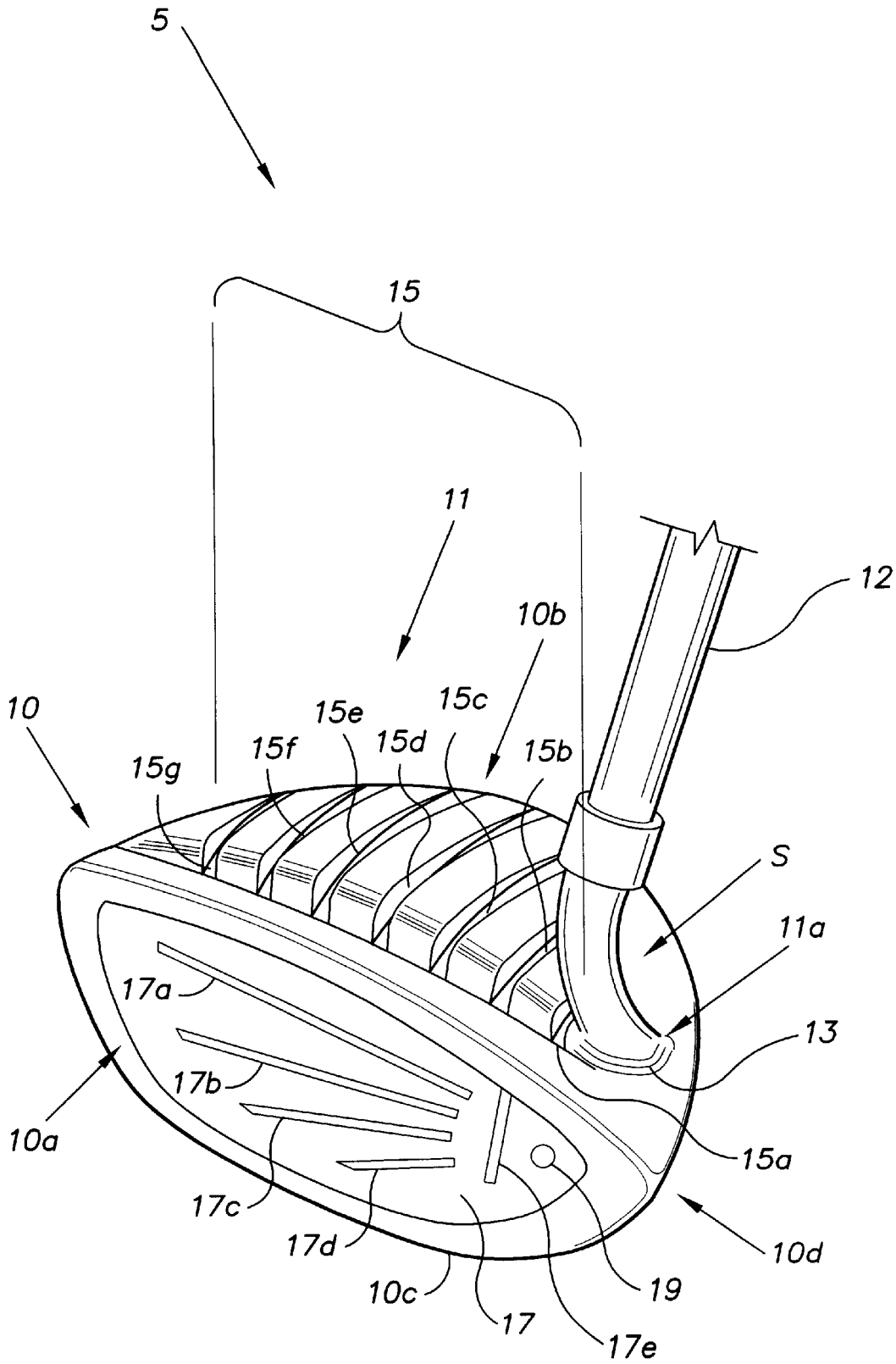
FIG. 2A is a perspective front view of the golf club according to the invention.
Figure 2B:
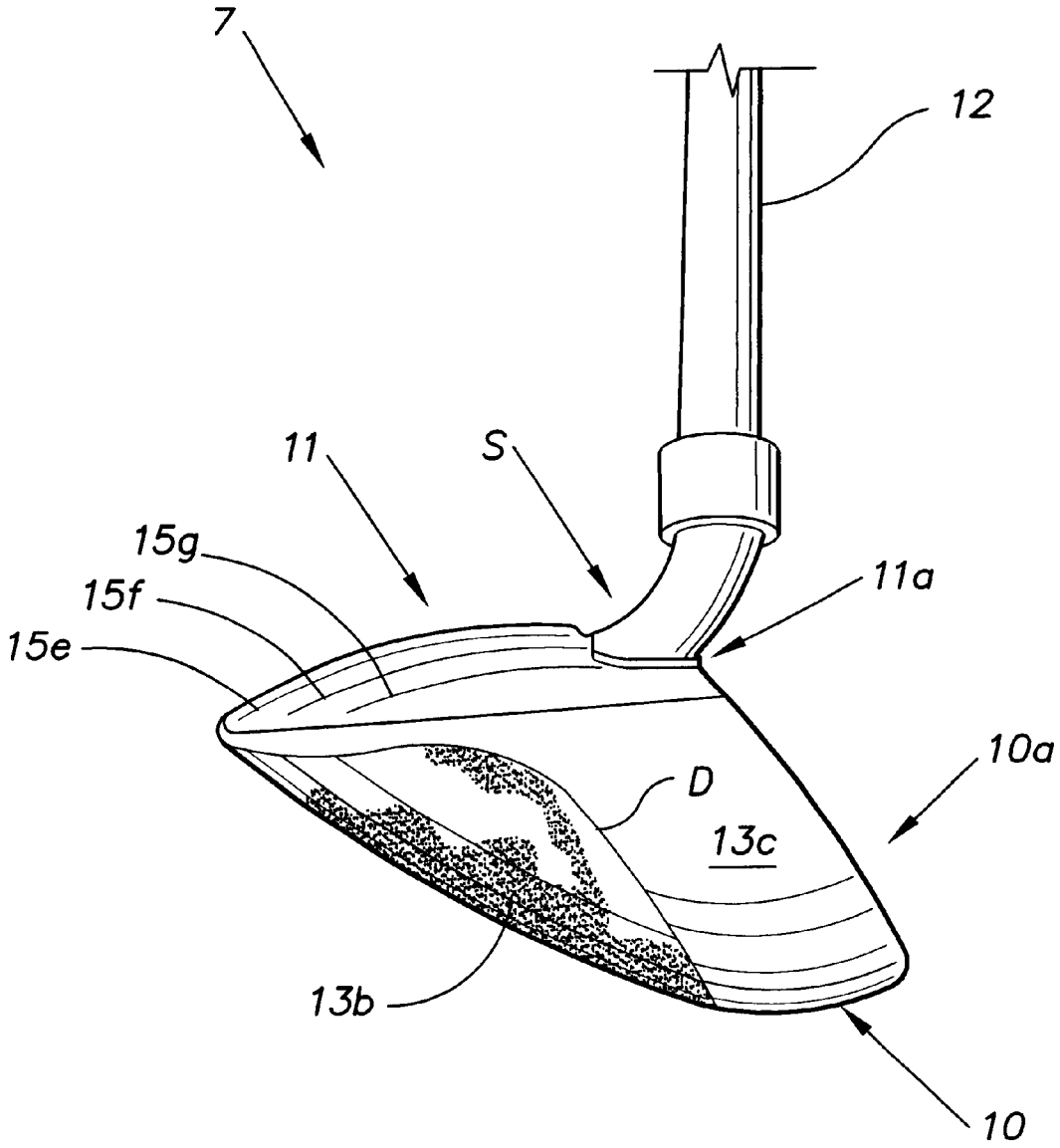
FIG. 2B is a side perspective view of the golf club according to the invention, illustrating a cavity contour with an optional epoxy fill to improve impact or vibration absorption characteristics of the club.
Figure 2C:
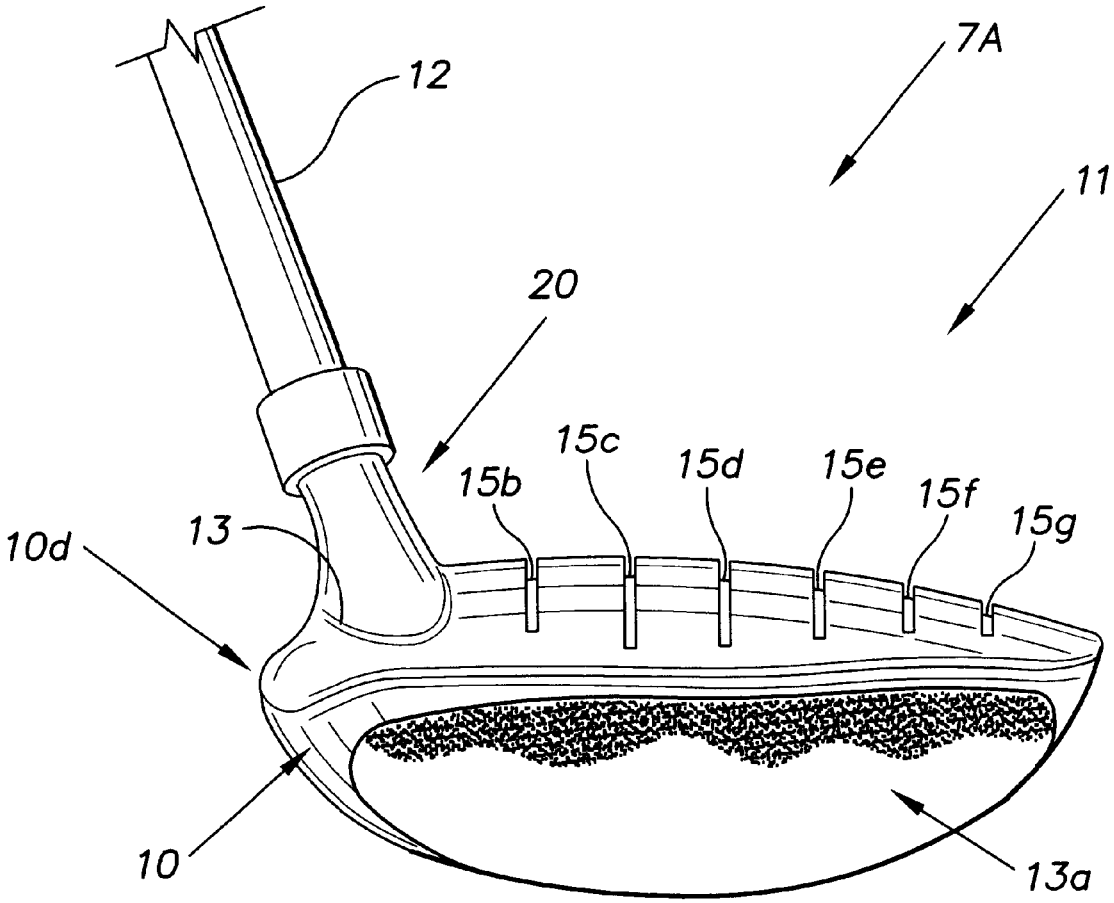
FIG. 2C is a rear perspective view of the golf club according to a second embodiment, illustrating a substantially elliptical shaped cavity contour, and a straight shaft connection to the top surface of the club.

As best seen in FIG. 2A, the series 15 preferably comprises seven grooves having at least one laminar layer (not shown in color). As recited above, each laminar layer has at least one pigment therein to form at least one distinct optical pattern for aligning a target therewith to make a particular chip or put shot. At least one optical pattern of the series 15, beginning at the shaft and radially forward in a direction opposite the heel of the shaft 12 includes wherein the respective first, fourth and seventh groove have at least one laminar layer having a pigment of orange, and the respective second, third, fifth and sixth groove have at least one laminar layer having a pigment of white disposed thereon. Depending on the color perception of a particular user U, the pattern can be customized to fit a unique or special color coded scheme. It has been found that the alternating orange and white pattern is an excellent alignment color code strategy which enables visual alignment of a target T with the impact surface 10*a* for making initiated chip shots without the need for extensive training to do the same.

The cavity structure of the golf club head 10 is shown in more detail as diagrammatically illustrated in FIGS. 2C–4C. According to FIG. 2C, a rear perspective view of the golf club 7A is shown according to a second embodiment, illustrating a substantially elliptical shaped cavity contour 13*a*, and a straight shaft hosel 20 connection to the top surface 13 of the club head 10. This particular embodiment also illustrates the plurality of grooves in the series 15 which forms the optical or visual gauge for aligning a target T for impact. A top perspective view of the club 7A is diagrammatically illustrated in FIG. 3A which illustrates the optical gauge pattern 15*a*–15*g* and a substantially planar impact plane 22.

Figure 3A:
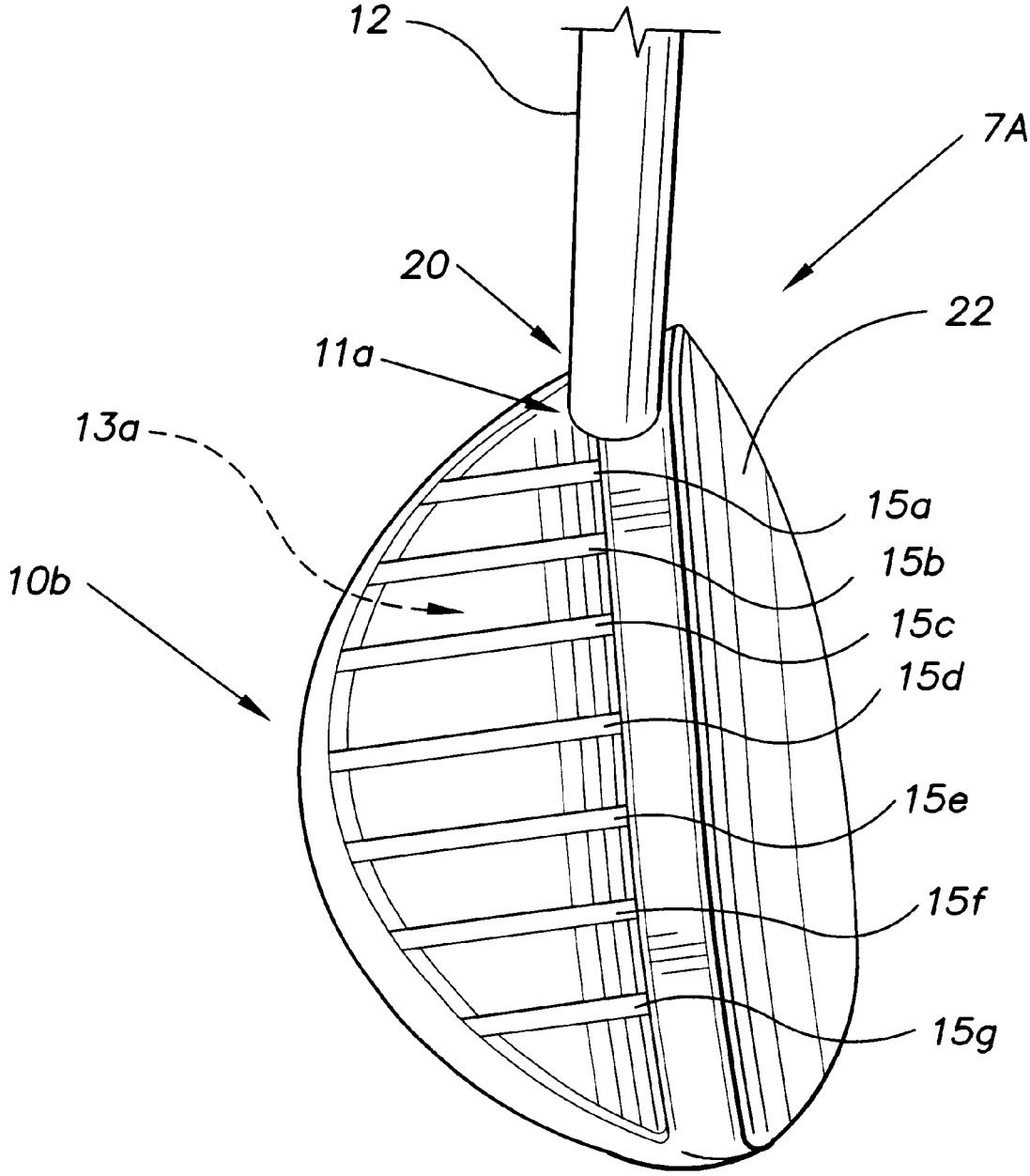
FIG. 3A is a top perspective view of FIG. 2C making the golf club according to the invention.
Figure 3B:
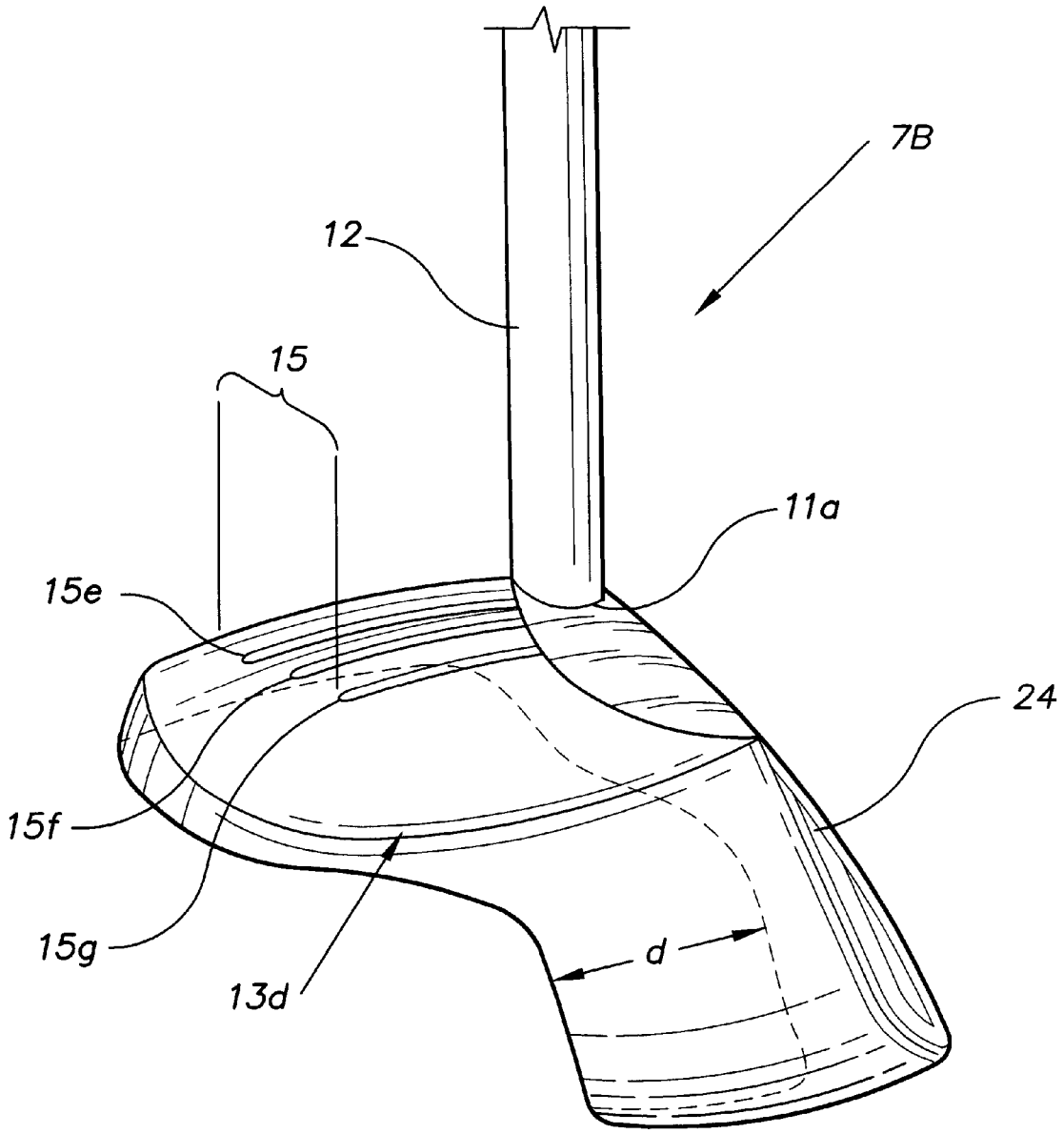
FIG. 3B is a side perspective view of the golf club head according to a third embodiment, illustrating a variable elevation contour of the front face or impact surface.

As diagrammatically illustrated in FIG. 3B, the club according to a third embodiment 7B is shown having a substantially rectangular aperture or cavity 13*d* with a critical impact depth d which allows for a certain degree a material removal from the club based on a customized weight requirement of the club 7B for a particular user. The impact plane 24 is also shown having a curved contour for adaptive control of and contact with a target T. In a similar fashion, the optical gauge pattern 15 is also depicted.

Figure 3C:
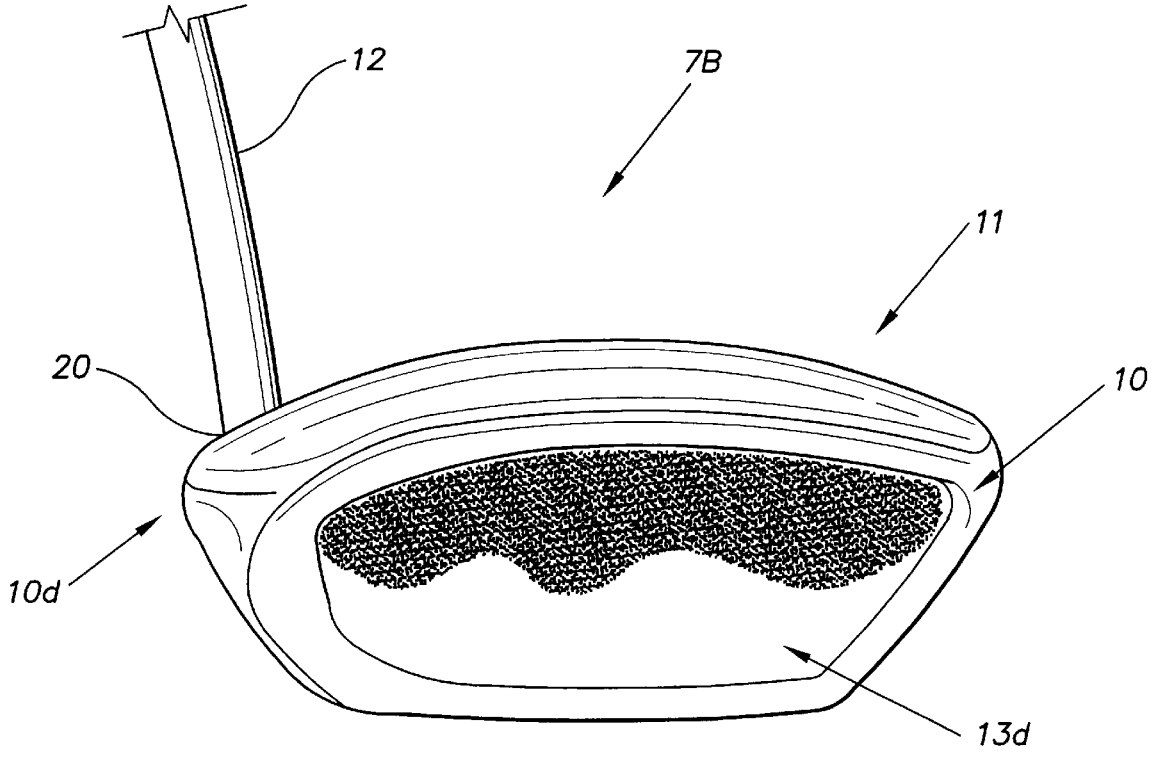
FIG. 3C is a rear perspective view of FIG. 3B, illustrating a substantially rectangular cavity contour.

The rectangular shaped cavity 13*d* more clearly shown according to a rear perspective view in FIG. 3C. As shown therein, the club 7B depicts the substantially rectangular cavity 13*d* according to a critical impact depth d as described above. Again, this particular parameter is determined as a custom feature or depending on the weight requirements of the club by a specific user U. As diagrammatically illustrated in FIGS. 4A–4B, a respective rear and side view of the invention is shown according to a fourth embodiment 8, illustrating a multi-layer material weighted cavity contour 13*e*. This variable weighted club 8 provides a cascade weighted effect within selective regions 30 and 31 of the club head 10 for providing greater impact with a target for making chip or put shots just outside the green or in the rough is a perspective side view of the golf club according to a fourth embodiment of the invention.

Figure 4A:
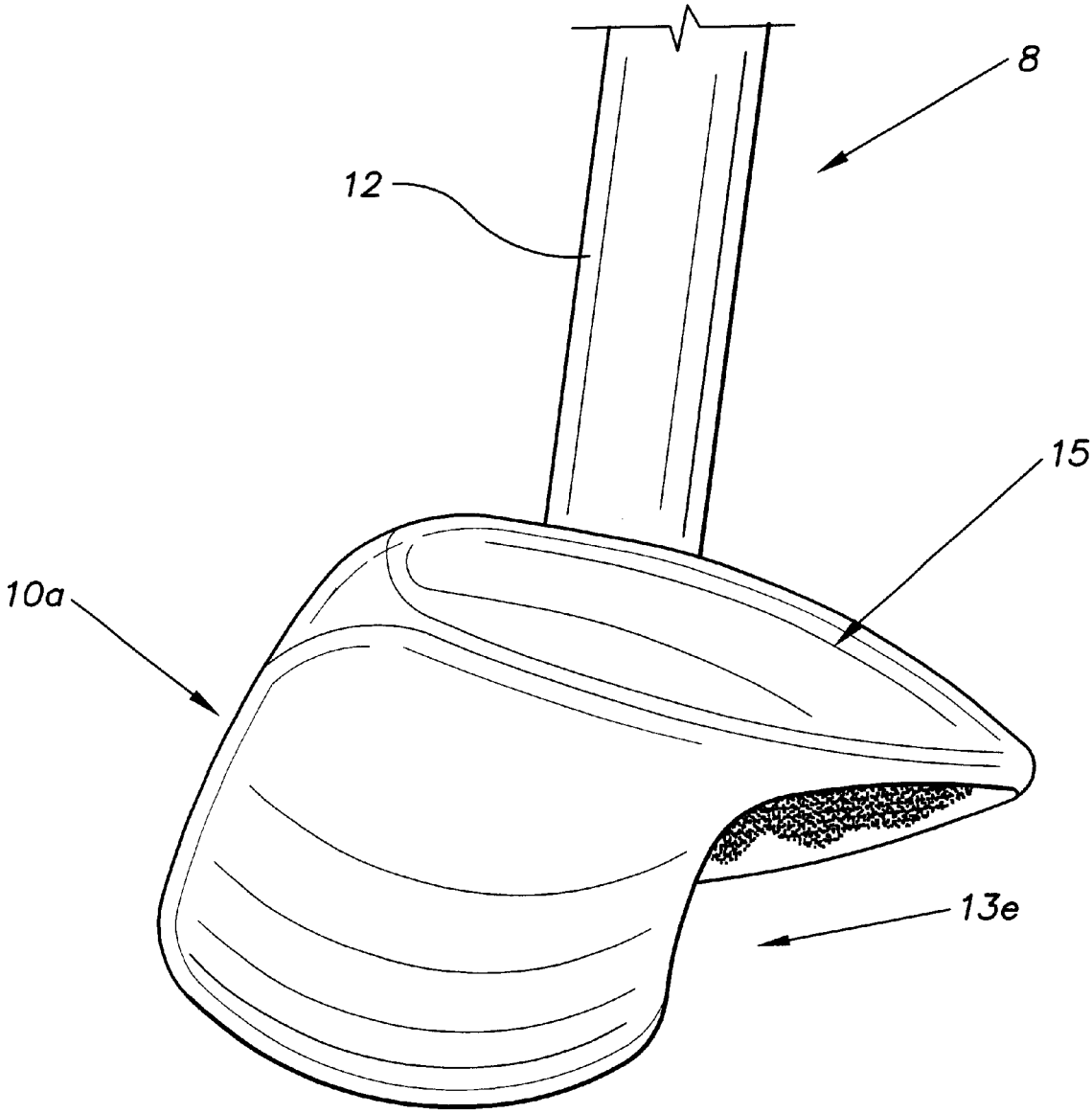
FIG. 4A is a perspective side view of the golf club according to a fourth embodiment of the invention.
Figure 4B:
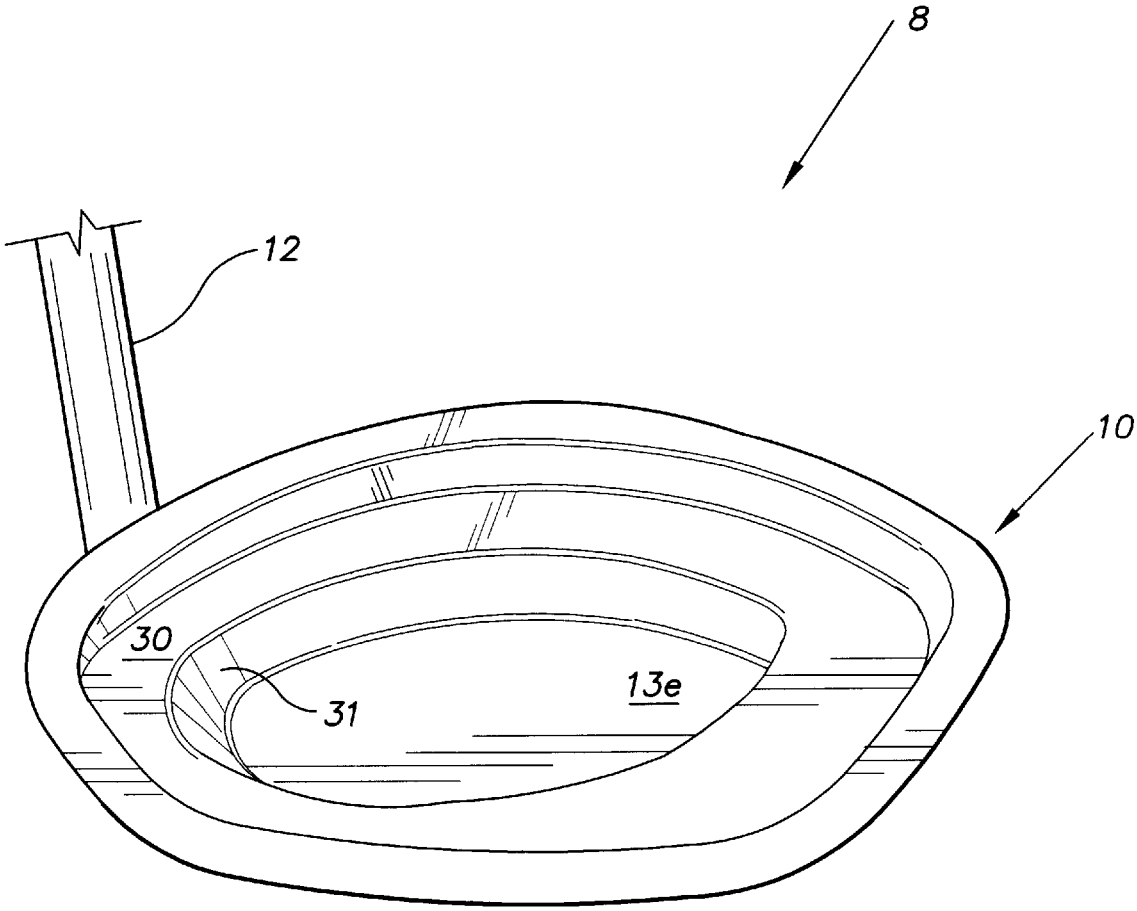
FIG. 4B is a perspective rear view of the golf club according to a fourth embodiment of the invention, illustrating a multi-layer material weighted cavity contour.
Figure 4C:
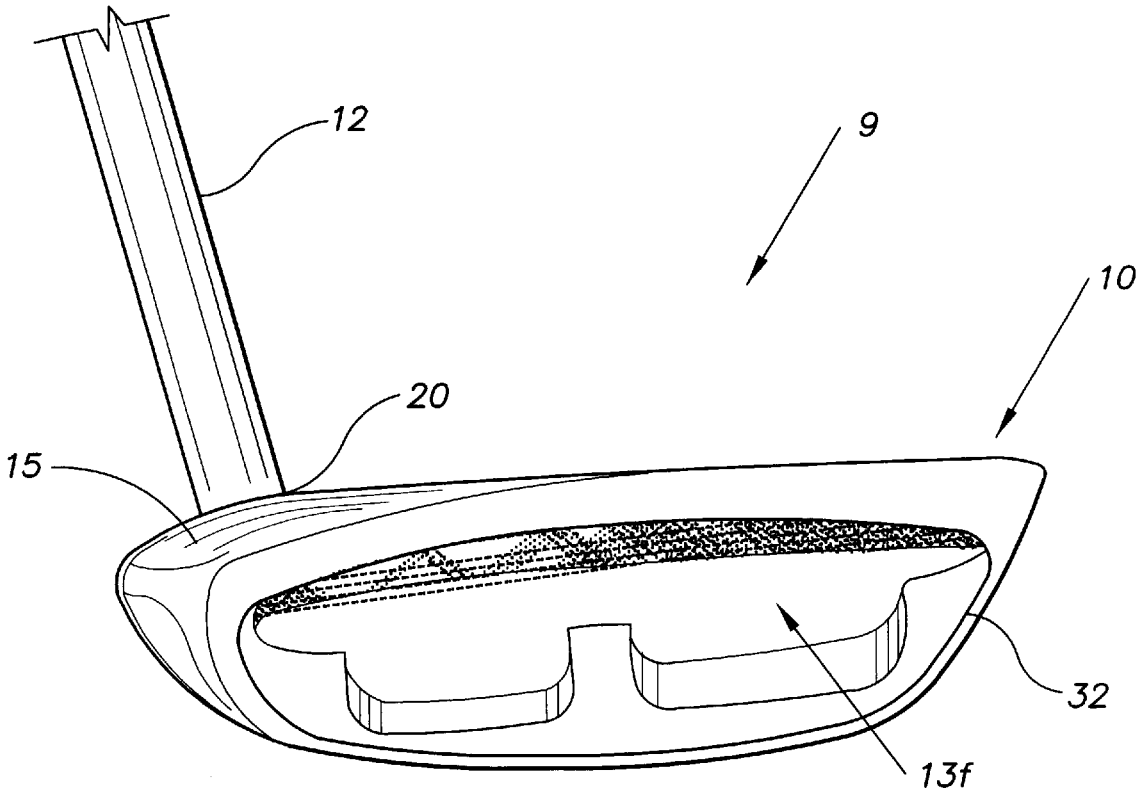
FIG. 4C is a perspective rear view of the golf club according to a fifth embodiment of the invention, illustrating a W-shaped material weighted cavity contour.

Another weighted club technique used according to the invention is diagrammatically illustrated in FIG. 4C according to a fifth embodiment 9. As shown therein, the club 9 illustrates a W-shaped material weighted cavity contour 13*f*. This particular weighted element is disposed substantially near the central base portion of the club and formed tapered towards the rear edge 32. This particular feature provides greater accuracy for a direct line of flight of the target T upon impact with the club 9.

Some finishing techniques may include the use of apertures as sub-surface elements to fasten the club head together when fabricated from a mold. These apertures cane be disposed in relation to the series of grooves 15. Accordingly, each aperture would provide a fastener insertion point for inserting a fastener to secure a bottom portion of the respective golf club heads 10 to an upper portion of the respective elements forme d from a mold. Mechanical fasteners or threaded fasteners can be used for securing the respective golf club heads 10 as a single integrated element. Any exposed areas in the finishing process can be finished via conventional filling techniques which are well known in the art. It should be noted, a variety of machining techniques are widely available to one having ordinary skill in the relevant art for providing finish details such threaded apertures, fillings, etc., and thus are not discussed in detail.

The impact plane and cavity features are illustrated as a projection ramp or impact reinforcement gradient. This gradient is also formed therein as a series of interlapping parabolic reinforcement support structures 13*e* as illustrated in FIGS. 4A and 4B. The gradient known as the "sweet spot" is disposed integral with the interior portion of the club 8 and behind the impact surface 10*a*. This particular feature serves to reduce localized stresses at the impact surface by distributing reaction forces throughout parabolic structures. Accordingly, this feature extends the life and repeated use of the club head without failure due to material of cyclical fatigue.

Accordingly, the striking or impact surface 10*a* of the golf club head 10 is angled to loft or chip a golf ball while employing a putting stroke. The top centering grooves on the top surface 11 are depicted having a sequence of colors arranged orange-white-white-orange(center groove)-white-white-orange. As recited above, the colors help focus the golfer's eyes and project a more broad-based target line-up, making it easier to keep the swing line of the club head 10 on track. The shaft 12 may be included in a pre-fabricated mold as well. It has been discovered that the shaft 12 of a selected length which has an special curvature S virtually eliminates twisting at the golf club head, thereby improving swing comfort for the user. This feature can be customized to accommodate physical and swing characteristics of a particular golfer. This particular customized feature helps to produce measurable and accurate results in the performance of the golfer within sixty yards of play to the green. Accordingly, the mass of the respective club heads 10 is balanced about the centroidal axis of the club 10, thereby providing comfort and minimal twisting at the point of impact around each golf club head 10.

The upright, centered position (ref. FIG. 1) at address places a convex, rounded contact to the ground with the leading edge of the striking face 10*a* positioned approximately ⅛ inch superior to the grounded contact area. Another distinguishing feature of the club 10 is that the front-to-back surface profile (illustrated in FIG. 2A) features a rounded, convex sole plate mesial to the shaft, hence the distal floor plate line angle is more angular. This reduces club head interference with the hinge axis at the head of the club through the swing. With respect to weight characteristics, the respective club heads 10 are preferably hollow and made of two piece machined construction thereby reducing material cost factors. The top portion is made preferably from aluminum and the bottom portion from stainless steel This arrangement "weights" the bottom or sole 10*c* of the club head 10 and produces a lower center of gravity. The lower center of gravity is enhanced by the additional stainless steel ramp of the impact plate 10*a* which is known as the "sweet spot" of the club's impact surface. The ramp defines the "sweet spot" and provides a more solid ball or target contact therewith. The club head 10 is designed so that the shaft 12 is inserted into the hole 11*a* thus eliminating the conventional hosel and accompanying "shanked" shots. The top, surface design, of the club head 10 integrates a surface design consisting of seven longitudinal lines parallel to the target T line and perpendicular to the plane of contact, which aids in the user's U line of sight alignment. The shaft 12 is attached at a lie angle of approximately 79 degrees for a shaft of 46 inches and over. The "lie angle" positions the golf club head 10 in the golfer's putter-stance position.

Other advantages of the golf club according to the invention includes wherein each respective shaft 12 further includes a handle portion comprising a moisture absorbing gripping surface 12*a* respectively. The effective results of the respective club heads 10 according to the invention are (1) an improved line of sight accuracy coefficient; (2) an improved chipping or putting effect to produce lofted shots with the ability to carry (in the air) over short distances of "off the green"; (3) an improved confidence "off the green" due to the ease of swing or the putting style to produce an effective inertia transfer to the ball; (4) the elimination or reduction of miss-hits (shanks, toe-shots, fat shots, etc.) resulting in tighter ball patterns of shots nearer the hole; and (5) an improvement in the number of "up-and-down" par saves from "off the green" to effectively lower a golfer's ultimate score.

It is to be understood that the present invention is not limited to the embodiments described above, but encompasses any and all embodiments within the scope of the following claims.

I claim:

1. A golf club comprising:

a golf club head having a substantially planar impact surface with a plurality of radially defined grooves, said grooves being formed with respect to a vertex groove and an intermediate substantially vertical groove for controlling impact with a target;

a rear portion, a sole portion, a top alignment surface, a heel portion and a shaft aligned according to a predetermined critical component angle and shaft length, said head is substantially oblong in shape;

said surface comprising an aperture disposed therein for fastening a shaft having an arcuate hosel and having a series of grooves formed parallel with respect to each adjacent groove in the series and formed orthogonal with said impact plate, wherein said grooves increase in depth from the rear portion towards the impact surface to form a series of substantially arcuate channels therein;

the series of grooves further include at least one laminar layer having at least one pigment of color for each groove in the series to create an optical pattern thereon with respect to each groove in the series for effecting user guided club head to target alignment for chipping; and wherein said golf club comprises a cavity contour having a predetermined impact distance with respect to the impact surface.

2. The golf club for chipping according to claim 1, wherein said series comprises seven grooves having said at least one laminar layer having said at least one pigment therein to form at least one distinct optical pattern for aligning chip shots.

3. The golf club for chipping according to claim 2, wherein said at least one optical pattern of the series formed by a laminar layer having at least one pigment of color in each groove comprises beginning at the shaft and radially forward opposite the heel of the shaft, said pattern being for a first, fourth and seventh groove at least one laminar layer having a pigment of orange and for a second, third, fifth and sixth grove at least one laminar layer having a pigment of disposed thereon.

4. The golf club for chipping according to claim 1, wherein said sole portion is a convex sole portion mesial to the shaft, a hollow golf club head having an substantially planar impact surface, a sole portion, a top alignment surface, a heel portion and a shaft, said head is substantially oblong in shape.

5. The golf club for chipping according to claim 4, wherein said cavity contour is substantially elliptical.

6. The golf club for chipping according to claim 4, wherein said cavity contour is substantially rectangular.

7. The golf club for chipping according to claim 4, wherein said cavity contour comprises as series of parabolic shaped material rings disposed therein at selective locations.

8. The golf club for chipping according to claim 4, wherein said cavity contour comprises as W-shaped weighted contour.

9. The golf club for chipping according to claim 1, wherein shaft further includes a handle portion comprises a moisture absorbing gripping surface.

* * * * *